US006576346B1

(12) United States Patent
Ravenscroft et al.

(10) Patent No.: US 6,576,346 B1
(45) Date of Patent: Jun. 10, 2003

(54) COMPOSITION AND METHOD FOR METAL COLORING PROCESS

(75) Inventors: Keith N. Ravenscroft, Long Lake, MN (US); William V. Block, Apple Valley, MN (US)

(73) Assignee: Birchwood Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 09/710,187

(22) Filed: Nov. 10, 2000

Related U.S. Application Data

(62) Division of application No. 09/317,304, filed on May 24, 1999, now Pat. No. 6,309,476.

(51) Int. Cl.[7] ..... B32B 15/04; C23C 28/00

(52) U.S. Cl. ..... 428/469; 148/276; 148/287; 428/472.2

(58) Field of Search ..... 428/469, 472.2; 148/276, 287

(56) References Cited

U.S. PATENT DOCUMENTS

| | | | |
|---|---|---|---|
| 3,899,367 | A | 8/1975 | Mitchell |
| 3,929,514 | A | 12/1975 | Houlihan et al. |
| 4,017,335 | A | 4/1977 | Maloney |
| 4,140,551 | A | 2/1979 | Jones |
| 4,298,405 | A | 11/1981 | Saus et al. |
| 4,565,585 | A | 1/1986 | Matsuda |
| 4,591,397 | A | 5/1986 | Jones et al. |
| 4,728,365 | A | 3/1988 | Jarvi |
| 4,789,409 | A | 12/1988 | Jarvi |
| 5,078,812 | A | 1/1992 | McCoy et al. |
| 5,089,349 | A | 2/1992 | Kaiser |
| 5,104,463 | A | 4/1992 | Menke |
| 5,580,063 | A | 12/1996 | Edwards |
| 5,591,275 | A | 1/1997 | Miyafuji et al. |
| 5,601,663 | A | 2/1997 | Rungta et al. |
| 5,667,599 | A | 9/1997 | Rungta et al. |
| 5,704,995 | A | 1/1998 | Bradley |
| 5,723,183 | A | 3/1998 | Williams et al. |

FOREIGN PATENT DOCUMENTS

JP 64-27938 A * 1/1989 ..... 428/469

OTHER PUBLICATIONS

Cotton and Wilkinson, Advanced Inorganic Chemistry—A Comprehensive Text, 1962, Interscience Publishers, pp. 847–863, (No Month).

Mark Ruhland of Birchwood Casey, Blackening of Ferrous Metals 1999 PF Directory (No Month).

Heatbath, New Blackening Technology literature, Mar., 1996.

Hubbard–Hall, Activated Black Magic Plus literature (No Date).

Du–Lite, Guide to Hot Black Oxide Processes, The Du–Lite Corporation, 1994 (No Month).

Godding, The Basics of Black Oxide Finishing, Products Finishing, Feb., 1990.

Godding, Why Black Oxide?, Products Finishing, Apr. 1986.

Daniels, Black–Oxide Basics, Products Finishing, Jul., 1992.

Birchwood Casey, In–House Blackening with No EPA Regulated Chemicals brochure (No Date).

Birchwood Casey, Guide to Room Termperature Antiquing without Hazardous Effluent brochure (No Date).

Birchwood Casey, Your Practical Guide and Cost Analysis brochure Aug., 1997.

* cited by examiner

*Primary Examiner*—Robert R. Koehler
(74) *Attorney, Agent, or Firm*—Gray, Plant, Mooty, Mooty & Bennett, PA; Malcom D. Reid

(57) ABSTRACT

This invention is a method for forming a chemical conversion coating on ferrous metal substrates, the chemical solutions used in the coating and the articles coated thereby. By modifying and combining the features of two existing, but heretofore unrelated, coating technologies, a hybrid conversion coating is formed. Specifically, a molecular iron/oxygen-enriched intermediate coating, such as a dicarboxylate or phosphate, is applied to a ferrous substrate by a first oxidation. The intermediate coating pre-conditions the substrate to form a surface rich in molecular iron and oxygen in a form easily accessible for further reaction. This oxidation procedure is followed by a coloring procedure using a heated (about 120–220° F.) oxidizing solution containing alkali metal hydroxide, alkali metal nitrate, alkali metal nitrite or mixtures thereof, which reacts with the iron and oxygen enriched intermediate coating to form magnetite ($Fe_3O_4$). The result is the formation of a brown or black finish under much more favorable, milder and safer conditions than previously seen with conventional caustic blackening processes, by virtue of the chemical reaction between the intermediate coating and the second oxidation solution. When sealed with an appropriate rust preventative topcoat, the final result is an ultra-thin, attractive and protective finish applied through simple immersion techniques. The finish is a final protective coating on a fabricated metal article and also affords a degree of lubricity to aid assembly, break-in of sliding surfaces or provide anti-galling protection. The finish also provides an adherent base for paint finishes.

27 Claims, No Drawings

COMPOSITION AND METHOD FOR METAL COLORING PROCESS

CROSS-REFERENCE TO RELATED PATENT APPLICATION

This application is a divisional application of Ser. No. 09/317,304, filed May 24, 1999, now U.S. Pat. No. 6,309,476.

BACKGROUND OF THE INVENTION

1. Field of the Invention

This invention relates to the formation of a hybrid chemical conversion coating on ferrous metal substrates, consisting of an iron/oxygen rich intermediate coating and a top layer of magnetite. This invention also relates to ferrous metal substrates coated according to the presently disclosed process. This invention further includes the oxidation solution used in oxidizing the iron/oxygen rich intermediate coating to the final magnetite containing top layer. This invention also includes a seven-step procedure for preparing a ferrous metal substrate with a magnetite containing coating.

2. Description of the Related Art

The established art of coloring ferrous metals has revolved principally around methods for producing black coatings. Since the 1950's, the most commonly used commercial method for blackening ferrous metals has been the caustic black oxidizing process. This method will be examined, along with the ferrous oxalate conversion coating on ferrous metal substrate and the iron phosphatizing process.

Caustic black oxidizing: This process uses sodium hydroxide, sodium nitrate and sodium nitrite as oxidizing agents, operating at about pH 14, at temperatures of about 285–305° F. A black coating is formed during exposures of about 10–30 minutes. This process forms a magnetite ($Fe_3O_4$) deposit, approximately 1 micron thick, by reacting with the metallic iron substrate in situ. Although the process produces high quality black finishes when operated properly, it has the disadvantage of requiring high temperatures and highly concentrated solutions (700–1000 grams per liter) to carry out the reaction.

During the course of operation, this reaction consumes oxidizing salts and the solution boils off significant quantities of water. These materials must be added back to the solution to maintain proper operating conditions. However, adding sodium hydroxide to water, being a highly exothermic reaction, is quite hazardous because the operating solution is already boiling. Likewise, adding make-up water to a solution which is already at 285–305° F. causes the water to instantly boil if not added very slowly and carefully. Consequently, the operation of the process poses severe safety hazards for personnel, due to the dangers involved in normal system operation and maintenance. These hazardous conditions may be difficult to justify in the manufacturing environments of modern industry. In addition, normal operating conditions typically entail heavy sludge formation in the process tank, difficulty in disposal of the spent solutions (due to extremely high concentrations), and variable quality on certain metals, including tool steel alloys, sintered iron articles or other porous substrates. Unless highly skilled operators are employed, this process may result in poor quality finishes. It is common to see undesirable red/brown finishes on certain alloys or salt leaching on porous substrates. As a result, the process is largely relegated to use by professional metal finishers who possess specialized knowledge and experience in dealing with hazardous materials.

Ferrous oxalate conversion coating: This coating was originally developed for use as a metal forming lubricant and anti-galling coating for mating parts. The finish is generally applied at about ambient temperatures, is about 1 micron thick and opaque gray in color. When sealed with a rust preventative topcoat, the oxalate offers some degree of corrosion protection. Used more commonly in the 1950's, the oxalate process is rarely used today, having given way to the several phosphate processes on the market, which offer more beneficial properties in terms of lubrication and/or paint adhesion.

Iron phosphate conversion coating: These coatings are widely used in the metal finishing industry as pretreatments to enhance paint adhesion and corrosion resistance on ferrous metal substrates. With a coating thickness of about 1 micron, the amorphous deposit is formed at temperatures of about 70–130° F. by a mildly acid solution which may also contain cleaning agents. The iron phosphate process has proven to be a very versatile and effective option in paint lines and other metal finishing process lines.

There have been several patents issued over the years which relate to blackening processes. For purposes of this invention, however, reference is made to prior patents which are directly related to oxalate and phosphate conversion coatings on ferrous metal substrates and to the caustic black oxidizing of ferrous metal substrates:

| U.S. Pat. No. | Date | Subject |
|---|---|---|
| 2,774,696 | Dec. 18, 1956 | Oxalate Coatings on Chromium Alloy Substrates |
| 2,791,525 | May 7, 1957 | Chlorate Accelerated Oxalate Coatings on Ferrous Metals for Forming Lubricity and Paint Adhesion |
| 2,805,696 | Sep. 10,1957 | Molybdenum Accelerated Oxalate Coatings |
| 2,835,616 | May 20, 1958 | Method of Processing Ferrous Metals to Form Oxalate Coatings |
| 2,850,417 | Sep. 2, 1958 | m-Nitrobenzene Sulfonate Accelerated Oxalates on Ferrous Metals |
| 2,960,420 | Nov. 15, 1960 | Composition and Process For Black Oxidizing of Ferrous Metals Using Mercapto-Based Accelerators and naphthalene based Wetting Agents |
| 3,121,033 | Feb. 11, 1964 | Oxalates on Stainless Steels |
| 3,481,762 | Dec. 2, 1969 | Manganous Oxalates Sealed with Graphite and Oil for Forming Lubricity |
| 3,632,452 | Sep. 17, 1958 | Stannous Accelerated Oxalates on Stainless Steels |
| 3,649,371 | Mar. 14, 1972 | Fluoride Modified Oxalates |
| 3,806,375 | Apr. 23, 1975 | Hexamine/$SO_2$ Accelerated Oxalates |
| 3,879,237 | Apr. 22, 1975 | Manganese, Fluoride, Sulfide Accelerated Oxalates |
| 3,899,367 | Aug. 12, 1975 | Composition and Process For Black Oxidizing Of Ferrous Metals Using Molybdic Acids On Tool Steels |
| 4,017,335 | Apr. 12, 1977 | pH Stabilized Composition and Method For Iron Phosphatizing Of Ferrous Metal Surfaces |
| 5,104,463 | Apr. 14, 1992 | Composition and Process For Caustic Oxidizing Of Stainless Steels Using Chromate Accelerators |

All but one of these oxalate patents pertain to the formation of a ferrous oxalate conversion coating on ferrous metal substrates using various accelerators. These oxalates are intended for use as functional coatings to aid in assembly or provide forming lubricity, etc. These coatings serve as deformable or crushable boundary layers at the metal surface, thereby protecting the base metal during contact with another surface.

The caustic black oxidizing patents focus on compositions and processes which oxidize the metallic iron substrate to a magnetite, $Fe_3O_4$, as described in U.S. Pat. No. 2,960,420. Actually, when examining the stoichiometry of the $Fe_3O_4$, one can see that the iron is not in either a purely ferrous (II) or ferric (III) oxidation state. Perhaps a more precise description of the material is that of a mixed salt, ferroso-ferric oxide, or $FeO—Fe_2O_3$, which exhibits both ferrous and ferric iron. The conventional caustic oxidizing processes all depend on the ability of the operating solution to oxidize metallic iron to both ferrous (II) and ferric (III) oxidation states to form the mixed oxide $FeO—Fe_2O_3$.

The process described in U.S. Pat. No. 4,017,335 is representative of the state of the art, focusing on the primary phosphatizing mechanism which is well known to those skilled in the art. In addition, this same patent illustrates incorporation of a cleaning agent and pH stabilizer into the oxidizing solution to effectively clean lightly soiled ferrous articles and iron phosphatize them in a single step.

SUMMARY OF THE INVENTION

This invention provides an alternative method and composition for forming aesthetically pleasing and protective, as well as functionally useful, magnetite coatings on ferrous metal substrates. The mechanism involves a first oxidation to provide an intermediate coating on the metallic iron substrate, such as a ferrous oxalate (or other dicarboxylate) or an iron phosphate coating, whose primary purpose is to act as a precursor to the magnetite. By providing a surface abundant in both molecular iron and molecular oxygen, the intermediate coating facilitates the formation of the magnetite (in a second oxidation), thereby requiring a blackening solution with much less oxidizing potential than is necessary with conventional oxidizing solutions in terms of concentration, operating temperatures and contact times. It is important to note that the oxidizing solution used in the second oxidation of this invention is not able to blacken the metal substrate without the intermediate coating (from the first oxidation) in place. The overall oxidizing potential of the second oxidizing solution in this invention is so much lower than that of conventional solutions that no reaction will take place unless the intermediate coating (from the first oxidation) has been applied first. After the second oxidation, the coating may be topcoated with a lubricant, rust preventative compound or polymer-based topcoat appropriate to the end use of the article.

A process according to this invention for forming a hybrid conversion coating on a ferrous metal substrate, encompasses applying to the substrate an intermediate coating rich in molecular iron and oxygen, and then contacting the intermediate coated substrate with an aqueous solution of oxidizing agents to form a magnetite containing surface. The substrate is coated with a water insoluble molecular oxygen and iron enriched intermediate coating by a first oxidation which comprises contacting the substrate with an aqueous solution of a dicarboxylic acid, or of a reagent selected from phosphoric acid, pyrophosphoric acid and salts thereof, or mixtures thereof, at an appropriate concentration, pH, temperature and time to achieve a desired water insoluble molecular oxygen and iron enriched intermediate coating. The intermediate coated substrate is then subjected to a second oxidation by contacting with an aqueous solution of an oxidizing agent at a concentration, pH, temperature and time to form the desired amount of magnetite. The coated substrate may then be sealed with a topcoat.

A coated colored ferrous metal article according to this invention has a surface formed by two treatments, wherein the first treatment is an iron/oxygen-enriched intermediate oxidized coating applied to a ferrous substrate, and the second treatment is a further oxidation of the first coating to magnetite.

An oxidation solution for oxidizing at least a portion of an iron/oxygen enriched intermediate coating on a ferrous substrate to magnetite according to this invention comprises an aqueous solution of oxidizing agents selected from alkali metal compounds of hydroxide, nitrate, and nitrite and mixtures thereof, and optionally further including an additional component selected from an accelerator, a metal chelator, a surface tension reducer and mixtures thereof.

This invention also provides a seven-step procedure for forming a hybrid conversion coating on a ferrous metal substrate, comprising the steps of:

(1) subjecting the ferrous metal substrate to treatment selected from cleaning, degreasing, descaling, and mixtures thereof;

(2) rinsing the substrate from step (1) with water;

(3) subjecting the substrate from step (2) to a first oxidation to form a molecular iron/oxygen enriched intermediate coating;

(4) rinsing the substrate from step (3) with water;

(5) subjecting the substrate from step (4) to a second oxidation to form a surface which is predominantly magnetite, $Fe_3O_4$;

(6) rinsing the substrate from step (5) with water; and (7) sealing the substrate with an appropriate topcoat.

DETAILED DESCRIPTION OF THE INVENTION

A ferrous metal substrate is defined herein as any metallic substrate whose composition is primarily iron. This may include steel, stainless steel, cast iron, gray and ductile iron, and sintered iron of all alloys.

The iron/oxygen rich intermediate coating applied to the substrate in the first oxidation can be formed using any of the water soluble dicarboxylic acids, especially aliphatic dicarboxylic acids generally of up to about five carbon atoms, such as oxalic, malonic, succinic, tartaric acids, and others and mixtures thereof. There are advantages and disadvantages to each dicarboxylic acid. For example, oxalic acid is generally available at the lowest cost and is the most reactive. However, oxalic acid tends to form intermediate coatings of relatively coarse grain, with large crystals and the intermediate coating usually benefits from the addition of a grain refiner to the first oxidation, such as alkali metal compounds of tartrate, tripolyphosphate, molybdate, citrate, polyphosphate and thiocyanate, including sodium potassium tartrate, sodium citrate, sodium molybdate, sodium polyphosphate and sodium thiocyanate. An intermediate coating with a denser crystal structure is considered preferable because it tends to produce a resultant black finish (after the second oxidation) that is cleaner, with less ruboff, and also thinner, which is desirable for most machine/tool applications. A mixture of two or more dicarboxylic acids tends to favor the formation of a denser microcrystalline structure on the metal surface, perhaps obviating the need for a grain refiner. However, the costs of many of the commercial grades of other dicarboxylic acids are significantly higher than that of oxalic acid, the solubilities are lower and the reaction rates significantly lower as well. In fact, these other longer chain aliphatic dicarboxylic acids may actually require the use of accelerators instead of or in addition to grain refiners in order to be workable in a practical sense. Suitable accelerators for use in the first oxidation include organic and inorganic nitro compounds, and alkali-metal compounds of citrate, molybdate, polyphosphate, thiocyanate, chlorate, and sulfide, such as sodium chlorate, sodium molybdate, and organic nitro compounds.

Alternatively, the iron/oxygen rich intermediate coating can consist of other coatings such as iron phosphate. The iron phosphate coating does not appear to be quite as effective as the dicarboxylate coatings, because the iron phosphate deposit tends to be amorphous rather than crystalline. Though the adhesion of iron phosphate to the substrate is generally satisfactory, the amorphous iron phosphate deposit tends to be less durable and less resistant to rubbing and/or wear factors, thus appearing to have more sooty ruboff in the final prepared article. The advantages of the phosphate coating, however, include the lower commercial cost of the chemicals and the ability to operate at higher (less acidic) pH levels. These advantages improve worker safety aspects of the process line. Appropriate reagents for deposition of the water insoluble phosphate-based coating include phosphoric acid, as well as alkali metal acid phosphates, alkali metal pyrophosphates, primary alkanol amine phosphates and mixtures thereof. Typically, the iron phosphate solutions are able to operate at about pH 3.0–5.0 (dicarboxylates operate at about pH 1.0–2.0), at temperatures of about 70–130° F., and contact times of 1–3 minutes.

An intermediate coating with a more densely formed crystal structure tends to concentrate or increase the availability of iron and oxygen and thus tends to favor the formation of the magnetite in the second oxidation. A more densely formed crystal structure tends to facilitate the blackening of certain ferrous alloys of lower reactivity, such as heat-treated steels or more highly alloyed steels. Typically, these types of steels tend to be less reactive because the concentration of metallic iron at the surface is lower than that encountered with cast irons or softer steels. Consequently, it is considered preferable to design the composition of the iron/oxygen rich intermediate coating solution to maximize the crystal structure density of the intermediate coating, thereby overcoming any low initial reactivity of iron substrate.

The operating temperature of the intermediate coating solution also has an effect on the reaction rate—higher temperatures tend to increase the reaction rate. Experimental evidence indicates that, although many iron alloys can be successfully processed at ambient temperatures, certain less reactive alloys benefit from application of the intermediate coating at temperatures of about 100–150° F. to overcome any low initial reactivity of the metal surface.

At suitable grain refiner for the first oxidation has been found to be an alkali metal tartrate, typically at a concentration of about 0.1–1.0 gram per liter. the accelerator is selected from organic and inorganic nitro compounds, alkali metal salts of citrate, molybdate, polyphosphate, thiocyanate, chlorate and sulfide at concentrations of about 0.5–5.0 grams per liter. A suitable accelerator for the first oxidation may be selected from organic and inorganic nitro compounds, typically at concentrations of about 0.1–5.0 grams per liter.

In summary, then, the composition of the intermediate coating solution (the first oxidation) may take many forms, depending on the cost, solubility and activity level of the chemicals used, the pH of the solution and coarseness of the crystal structure, as well as the initial reactivity of the iron metal alloy, the value or intended use of the article and other factors deemed pertinent to each application.

After coating the article with the iron/oxygen rich intermediate coating, the article is blackened by contacting it with a second oxidation solution at elevated temperatures to form the magnetite. Experimental evidence indicates that most of the intermediate coating remains intact on the article surface after the second oxidation, with only a small portion of the coating reacting to form magnetite. Although the exact reaction mechanism of the second oxidation is not clearly understood, it is believed that portions of the intermediate coating react with the second oxidation solution to form magnetite interspersed within the crystal structure of the coating. Some magnetite may be chemically bonded to molecules of the intermediate coating.

The first oxidation is believed to convert metallic iron, to Fe(II), when the coating is a ferrous dicarboxylate, or to a mixture of Fe(II) and Fe(III) when the coating is an iron phosphate. Accordingly, in this specification the dicarboxylate coating is designated as "ferrous," because the iron is in the ferrous or Fe(II) oxidation state, while the phosphate coating is designated more broadly as "iron," because the iron is in both the ferrous, Fe(II), and ferric, Fe(III), oxidation states. It is reasonable to believe that the primary iron oxide formed is $Fe_3O_4$, although it is possible that other iron oxides are formed, such as FeO and $Fe_2O_3$, and other compounds, such as FeS, SnS and SnO (due to the possible presence of sulfur and tin in the reagent solutions), all of which can be gray/black in color. The oxides of iron tend to be non-stoichiometric, and readily interconvertible with each other. The tendency of each of the iron oxides to be nonstoichiometric is due to some extent to the intimate relationship between their structures. The structure of each oxide may be visualized as a cubic close-packed array of oxide ions with a certain number of Fe(II) and/or Fe(III) ions distributed among octahedral and tetrahedral holes. Each of the iron oxides can alter its composition in the direction of one or two of the others without there being any major structural change, only a redistribution of ions among the tetrahedral and octahedral interstices. This accounts for their ready interconvertibility, their tendency to be nonstoichiometric, and, in general, the complexity of the Fe-O system. For further discussion of the oxides of iron, see, for example, Cotton and Wilkinson, *Advanced Inorganic Chemistry*, Interscience Publishers, 1966, 2nd edition, pages 847–862.

The second oxidation then converts at least a portion of the intermediate coating to magnetite. The exact reaction mechanism for the second oxidation has not been determined. However, the non-stoichiometric nature and easy interconvertibility of these iron compounds, as recognized by the art and as discussed in Cotton and Wilkinson, makes it reasonable to believe that the resultant black coating is composed of a mixture of iron and oxygen which only loosely resembles precise, or discrete, compounds.

The composition of the second oxidation solution can vary, depending on the type, thickness and grain structure of the prepared intermediate coating. Generally, it is considered preferable to add at least one, two or even three oxidizers and an accelerator to the second oxidation solution. The primary oxidizers may be alkali metal compounds of hydroxide, nitrate, and nitrite and mixtures thereof. Specific examples of suitable primary oxidizers include sodium hydroxide, sodium nitrate and sodium nitrite in varying concentrations. In every case, however, the overall concentration of oxidizers according to this invention is significantly lower than that seen in the conventional oxidizing processes as described in the U.S. patents cited earlier. For example, U.S. Pat. No. 3,899,367 suggests the following concentrations in the oxidizing solutions:

| | |
|---|---|
| sodium hydroxide | 200–1000 grams per liter |
| sodium nitrate | 12–60 grams per liter |
| sodium nitrite | 30–150 grams per liter. |

along with minor concentrations of such additives as accelerators and wetting agents.

Actual practice in the metal finishing industry indicates that only the upper end of the concentration range shown in the above example from U.S. Pat. No. 3,899,367 is effective in producing a satisfactory black magnetite coating. Solutions of lower concentrations tend to boil at lower temperatures, leading to formation of undesirable red and brown coatings with less than satisfactory results.

According to the present invention, the optimal concentrations used for the second oxidation solution to produce satisfactory final black magnetite coatings may be as follows:

| | |
|---|---|
| sodium hydroxide | 25–200 grams per liter |
| sodium nitrate | 9–70 grams per liter |
| sodium nitrite | 1–10 grams per liter |

Additional components which may be added to the second oxidation solution include accelerators, metal chelators and surface tension reducers. Appropriate accelerators for the second oxidation include organic and inorganic nitro compounds, alkali metal compounds of citrate, molybdate, polyphosphate, vanadate, chlorate, tungstate, thiocyanate, dichromate, stannate, sulfide and thiosulfate, and stannous chloride and stannic chloride. Suitable accelerators are chosen according to such considerations as cost and solubility. Appropriate metal chelators include alkali metal compounds of thiosulfate, sulfide, ethylene diamine tetraacetate, thiocyanate, gluconate, citrate, and tartrate. Suitable chelators are chosen according to such considerations as cost, solubility and reactivity. Appropriate surface tension reducers include alkylnaphthalene sulfonate and related compounds which are stable in high pH environments.

A suitable accelerator for the second oxidation is selected from alkali metal salts of molybdate, vanadate, tungstate, thiocyanate, dichromate, stannate, thiosulfate, stannous chloride, and stannic chloride, preferably at concentrations of about 0.05–0.5 grams per liter. A suitable metal chelator for the second oxidation is selected from alkali metal salts of thiosulfate, sulfide, ethylene diamine tetraacetate, thiocyanate, gluconate, citrate or tartrate, preferably at concentrations of about 1.0–10.0 grams per liter. A suitable surface tension reducer for the second oxidation is selected from alkylnaphthalene sulfonate, typically at concentrations of about 0.025–0.2 grains per liter.

Suitable reaction parameters for the second oxidation are as follows: pH range: about 12.0–14.0, typically about 13.0–14.0; operating temperature range: about 120–220° F., typically about 160–200° F.; contact time range: about 0.5–10 min., typically about 2–5 min. Temperatures as low as about 70–80° F. at reaction times of 30 min. or more have successfully been used.

The iron/oxygen rich intermediate coating (from the first oxidation) is responsible for reducing the minimum oxidizing potential necessary for satisfactory coatings. Since the substrate metal has already been oxidized by the intermediate coating solution (the first oxidation), it is easier for a less powerful oxidation solution to finish the oxidation to the black magnetite level (the second oxidation). The second oxidation solution is unable to react with metallic iron; the second oxidation solution reacts only with the pre-existing, easily accessible iron and oxygen contained in the intermediate coating. Because the intermediate coating (from the first oxidation) facilitates the second oxidation reaction, a much less powerful second oxidation solution is required than has been typically used in conventional blackening processes.

In like manner, the operating temperature and contact time for the second oxidation is significantly reduced from similar parameters for conventional oxidizing solutions. Again, U.S. Pat. No. 3,899,367 suggests an operating temperature of 255–325° F. and contact times of 10–25 minutes. In actual practice, the optimal operating temperature for the process of U.S. Pat. No. 3,899,367 has been found to be about 285–295° F. with 10–25 minute contact time. According to the present invention, the optimal temperature range for the second oxidation is about 190–220° F. for black coatings and about 160–190° F. for brown coatings. Optimal contact times are about 2–10 minutes. Both of these parameters are significantly lower than for the conventional oxidizing solutions employed in U.S. Pat. No. 3,899,367.

Among the important advantages of the process of this invention are the suprisingly low temperatures at which this second oxidation may successfully operate. Reactions at temperatures as low as about 70–80° F. produce products with highly acceptable colored surface finish, generally by increasing the contact time, for example, up to about 30 min. or more. The ability to successfully operate at such suprisingly low temperatures offers substantial advantages in providing a process which may be safely and effectively carried out by an end user. Such 'low temperature—longer time' procedures produce attractive finishes for less demanding final products, including such decorative and artistic products as ornamental wrought iron work, finish hardware, sculptural works, craft and artisan handworks, and similar enhancements. These finishes from the 'low temperature—longer time' procedures may evidence colors in the black to dark black-brown range. Further embellishment of the colored product may involve removal of some of the colored finish to reveal the bright underlying metal, achieving a patina or antique effect. Although it is of course known in reaction kinetics that lowering an operating temperature may call for increasing reaction times, the ability to operate at such surprisingly low temperatures has nowhere been reported in this industry, to the knowledge of the present inventors.

Along with the primary oxidizing agents mentioned, the second oxidation solution may preferably contain an accelerator. In the present invention, the accelerators for the second oxidation solution may be alkali metal compounds of molybdate, vanadate, tungstate, thiocyanate, dichromate, stannate or thiosulfate, or stannous or stannic chloride, or mixtures thereof. Suitable accelerators include stannous chloride, stannic chloride, sodium stannate, sodium thiosulfate, sodium molybdate and ethylene thiourea, and mixtures thereof. Other accelerators which have been mentioned in prior related literature, including sodium dichromate, sodium tungstate, sodium vanadate, sodium thiocyanate and benzothiazyl disulfide, all show varying degrees of effectiveness in the second oxidation of this invention. In addition, surface tension reducing agents tend to improve rinsability and reduce dragout from the solution. Effective surface tension reducing agents include alkyl naphthalene sodium sulfonate, such as manufactured by the Witco Corporation under the trademark Petro AA, and similar surface tension reducing agents.

It is important to note that, in the second oxidation of this invention, the overall concentrations of the primary oxidizers and the relative concentrations of each oxidizer in the second oxidation solution are factors critical to success. It has been stated that the second oxidation solution of this invention is not able to react with metallic iron, because the oxidizing potential of the solution is too low. Similarly, treating a ferrous substrate, as defined above, with a conventional oxidizing solution and merely reducing the concentration, temperature and contact time will not result in satisfactory finishes. In general, the finishes obtained by treating a ferrous substrate with a conventional oxidizing solution at reduced concentration, temperature and contact time is a loosely adherent coating with an undesirable brown color. For example, the oxidizing solution described in U.S. Pat. No. 2,960,420, when operated at reduced concentrations, contact times and temperatures (at about 190–200° F.) reacts poorly with the intermediate coating, producing finishes which are brown and very loosely adherent. In like manner, the oxidizing solutions described in U.S. Pat. No. 3,899,367 under similar operating conditions also produce undesirable thin, loosely adherent brownish coatings.

The primary benefits derived from the process according to the present invention are not related to the quality of the black finish itself, but rather to processing advantages. These improved advantages include lower operating temperatures, shorter process times, and lower solution concentrations, which lead to enhanced worker safety and lower operating costs. The resultant black finish itself is very comparable to that of conventional blackening processes in terms of corrosion resistance, wear resistance, appearance, thickness, and applications in which the finished article is used.

The present inventive process entails the deposition of an intermediate conversion coating, which is rich in iron and oxygen and represents a first oxidation of the metallic iron of the substrate. This first oxidation (forming the intermediate conversion coating) is followed by a second oxidation, which forms a magnetite compound by reacting with the intermediate coating. The precise chemical composition of the resultant black finish has not been identified. The chemical literature, as discussed above, suggests that there are three oxides of iron, all of which are likely present in the intermediate conversion coating: FeO, $Fe_2O_3$ and $Fe_3O_4$ with $Fe_3O_4$ being a mixed salt of FeO and $Fe_2O_3$. Besides these iron oxides, it is likely that other salts are formed on the surface, including FeS, SnS, SnO in minor quantities, due to the presence of sulfur and tin-based additives in the solution.

The first oxidation and the intermediate conversion coating formed by this invention, which may be a dicarboxylate, a phosphate, mixtures thereof, or some other iron/oxygen rich material, depending on the oxidation solution used, are not per se novel. The first oxidation and the intermediate conversion coating are in fact based on known chemistry. The novelty of the present invention is the use of these coatings (and the processes forming them) in the context of a blackening process. The novelty of the process, and the key to its success, lies in the second oxidation solution and its reaction with the intermediate coating. The concept of an initial oxidation of the metallic iron, to form an intermediate dicarboxylate, phosphate or other iron/oxygen enriched coating, followed by a further oxidation of the intermediate coating is a novel concept in this industry and depends on the composition and operating parameters of the second oxidization solution.

Our research to date does not indicate that the entire dicarboxylate, phosphate or other iron/oxygen-enriched intermediate coating from the first oxidation is converted to iron magnetite, $Fe_3O_4$, in the second oxidation. Rather, our experimental work suggests that the second oxidation solution is reacting with molecular iron and oxygen of the intermediate coating. Although the entire intermediate coating is rich in molecular iron and oxygen, it is reasonable to assume that the area in which these materials are most accessible is at the top surfaces of the intermediate coating crystal structure. Indeed, our tests have indicated that the black finish formed by the entire process (the first and the second oxidations) of this invention can be stripped off a steel article with hydrochloric acid, leaving a gray-looking finish behind. This gray-looking finish is the intermediate coating. The article can then be immediately re-blackened by immersion in the second oxidation solution. We have determined experimentally that the second oxidation solution has no effect on metallic iron. The stripping and re-blackening experiment reasonably suggests that only the top surface of the intermediate coating is turning black. If the entire intermediate coating were being converted to black iron magnetite, the hydrochloric acid stripping operation would remove all of the coating, down to the metallic iron, and it would be impossible to re-blacken the article without first re-coating it with the intermediate coating.

The invention will now be further illustrated by the description of certain specific examples of its practice which are intended to be illustrative only and not limiting in any sense.

EXAMPLES 1

First Oxidation: A 1018 steel article is cleaned by conventional means. The cleaned article is then immersed for 1 minute at room temperature in an aqueous solution containing:

| | |
|---|---|
| Oxalic Acid | 14 g/l |
| Phosphoric Acid | 1.2 g/l |
| Sodium m-Nitrobenzene Sulfonate | 6 g/l |
| Sodium Potassium Tartrate | 0.4 g/l |

The above immersion produces an opaque gray intermediate coating on the steel surface.

Second Oxidation: After rinsing, the intermediate coated article is immersed for 4–5 minutes at 200° F. in an aqueous solution containing:

| | |
|---|---|
| Sodium Hydroxide | 100 g/l |
| Sodium Nitrate | 35 g/l |
| Sodium Nitrite | 5 g/l |
| Sodium Thiosulfate | 5 g/l |
| Sodium Molybdate | 5 g/l |
| Stannous Chloride | 0.2 g/l |
| Petro AA | 0.1 g/l |

During this second immersion, the article gradually takes on a black color due to the formation of magnetite on the surface. The article is then rinsed in water and sealed in a water-displacing oil topcoat which serves as a rust preventative. The resultant coating is opaque black in color, tightly adherent, with corrosion resistance equal to that provided by the topcoat oil sealant.

EXAMPLE 2

First Oxidation: A 4140 heat-treated steel cutting tool is cleaned and descaled by conventional means. The tool is then immersed for 90 seconds at 120° F. in an aqueous solution containing:

| | |
|---|---|
| Oxalic Acid | 14 g/l |
| Phosphoric Acid | 1.2 g/l |
| Sodium m-Nitrobenzene Sulfonate | 6 g/l |

The above immersion produces an opaque gray coating on the steel surface. Because the 4140 steel is less reactive than the 1018 steel used in Example 1, the above oxidation solution has been modified from the first oxidation solution of Example 1 to eliminate the grain refiner (Sodium Potassium Tartrate), and to raise the operating temperature to make the reaction more aggressive.

Second Oxidation: After rinsing in water, the tool is immersed for 8 minutes at 200° F. in an aqueous solution containing:

| | |
|---|---|
| Sodium Hydroxide | 100 g/l |
| Sodium Nitrate | 35 g/l |
| Sodium Nitrite | 5 g/l |
| Sodium Thiosulfate | 5 g/l |
| Sodium Molybdate | 5 g/l |
| Stannic Chloride | 0.2 g/l |
| Petro AA | 0.1 g/l |

During the second immersion, the tool gradually takes on an opaque black color. The tool is then rinsed in water and sealed with a water-displacing rust preventative oil.

EXAMPLE 3

First Oxidation: A mild steel decorative article is cleaned by conventional means and immersed for 1 minute at room temperature in an aqueous solution containing:

| | |
|---|---|
| Oxalic Acid | 14 g/l |
| Phosphoric Acid | 1.2 g/l |
| Sodium m-Nitrobenzene Sulfonate | 6 g/l |
| Sodium Potassium Tartrate | 0.4 g/l |

The above immersion will produce an opaque gray intermediate coating on the article surface after rinsing.

Second Oxidation: The article is then immersed for 6 minutes at 180° F. in an aqueous solution containing:

| | |
|---|---|
| Sodium Hydroxide | 100 g/l |
| Sodium Nitrate | 27 g/l |
| Ethylene Thiourea | 0.6 g/l |
| Tin (IV) Chloride | 2 g/l |

-continued

| | |
|---|---|
| Sodium Dichromate | 0.3 g/l |
| Petro AA | 0.1 g/l |

During the second immersion above, the article gradually takes on an opaque brown color. The article is then rinsed in clear water and sealed in a clear acrylic polymer-based topcoat. The resultant coating may serve as an aesthetic finish for decorative hardware, etc.

EXAMPLE 4

First Oxidation: A sintered iron metal article is cleaned by conventional means and immersed for 3 minutes at 120° F. in an aqueous solution containing:

| | |
|---|---|
| Phosphoric Acid | 28 g/l |
| Hydrofluosilicic Acid | 8 g/l |
| Xylene Sulfonic Acid | 3 g/l |
| Dodecylbenzene Sulfonic Acid | 2 g/l |
| Monoethanolamine | 17 g/l |
| Sodium m-Nitrobenzene Sulfonate | 1 g/l |
| Molybdenum Trioxide | 0.2 g/l |

After this immersion, the article has an intermediate coating of an opaque gray iron phosphate deposit.

Second Oxidation: After rinsing in water, the article is immersed for 5 minutes at 200° F. in an aqueous solution containing:

| | |
|---|---|
| Sodium Hydroxide | 100 g/l |
| Sodium Nitrate | 35 g/l |
| Sodium Nitrite | 5 g/l |
| Sodium Thiosulfate | 5 g/l |
| Sodium Tungstate | 5 g/l |
| Sodium Stannate | 0.2 g/l |
| Petro AA | 0.1 g/l |

During the above immersion, the article gradually takes on a black color. After rinsing in water, the article is sealed in a water-displacing rust preventative oil. The resultant finish is somewhat more fragile than that deposited in Examples 1 and 2, but may be considered preferable for certain applications because of the expected lower operating cost. In addition, the extremely porous substrate produced by this process may tend to make the fragile nature unimportant, depending on the end use of the article.

Because of the potentially dangerous nature of the prior known metal blackening processes, many manufacturers have found it more convenient to send parts to an outside vendor for application of a black finish. This, of course, is inefficient and adds to the overall cost of production. A particular feature of this invention is a seven-step process which may be provided in a set-up of seven baths or containers, so that a metal manufacturer may safely and conveniently carry out in-house metal blackening without the risk to employees posed by such previous blackening procedures. The inventive process may be commercially carried out as a seven step process as follows:

Step 1: The article is cleaned, degreased and descaled (if necessary) to remove foreign materials such as fabricating oils, coolants, extraneous lubricants, rust, millscale, heat treat scale, etc. The aim here is to generate a metal surface which is free of oils and oxides, exposing a uniform and reactive metal surface. Any method of providing such a surface known to the metal finishing industry is suitable. Acceptable methods include conventional cleaning in an alkaline detergent soak cleaner, solvent degreasing or electrocleaning. Descaling can be accomplished by acid or caustic descaling methods. Abrasive cleaning methods such as bead blasting, shot peening and vapor honing may be used with good results. All these methods are well known to the metal finishing industry.

Step 2: The article is rinsed in clean water to remove any cleaning residues from the surface.

Step 3 (First Oxidation): The article is then subjected to a first oxidation to provide an intermediate coating on the metallic iron substrate. The oxidation reagent is an aqueous solution of either a dicarboxylate or a phosphate or mixtures thereof, optionally with a grain refiner, to provide a water insoluble dicarboxylate-based deposit or a water insoluble phosphate-based deposit, or mixtures thereof. Appropriate dicarboxylic acids include aliphatic dicarboyxlic acids, generally of up to about five carbon atoms, such as oxalic, malonic, succinic, glutaric, adipic, pimelic, maleic, malic, tartaric, or citric acid, and mixtures thereof. When the intermediate coating is a ferrous oxalate, suitable reaction parameters are as follows: pH range: about 0.5–2.5, typically about 1.6; operating temperature range: about 50–150° F., typically about 75° F.; contact time range: about 0.5–5.0 min., typically about 2 min.

Appropriate reagents for deposition of the water insoluble phosphate-based coating include phosphoric acid, as well as alkali metal acid phosphates, alkali metal pyrophosphates or primary alkanol amine phosphates. When the intermediate coating is a iron phosphate, suitable reaction parameters are as follows: pH range: about 3.0–5.5, typically about 4.0–5.0; operating temperature range: about 60–180° F., typically about 120–130° F.; contact time range: about 1–10 min., typically about 3–5 min.

Appropriate grain refiners include alkali metal compounds of tartrate, tripolyphosphate, molybdate, citrate, polyphosphate and thiocyanate, such as sodium potassium tartrate. A suitable grain refiner is sodium potassium tartrate.

A suitable first oxidation solution according to this invention is prepared as follows:

| Component | Concentration | Acceptable Range |
|---|---|---|
| Oxalic acid | 14 g/l | 3–35 g/l |
| Phosphoric acid | 1.2 g/l | 0.5–3.0 g/l |
| Sodium m-Nitrobenzene sulfonate | 6 g/l | 1–15 g/l |
| Sodium Potassium Tartrate | 0.4 g/l | 0.1–2.0 g/l |

Contact time in this solution is usually about 1–3 minutes at about 50–150° F. The resulting deposition is an opaque, gray dicarboxylate intermediate coating.

Alternatively, an iron phosphating solution can be used to deposit an intermediate coating which is also effective. A suitable composition and acceptable range of concentrations for this option are shown below:

| Component | Concentration | Acceptable Range |
|---|---|---|
| Phosphoric acid | 28 g/l | 7–70 g/l |
| Hydrofluosilicic acid | 8 g/l | 2–20 g/l |

-continued

| Component | Concentration | Acceptable Range |
|---|---|---|
| Xylene Sulfonic acid | 3 g/l | 1–7.5 g/l |
| Dodecylbenzene sulfonic acid | 2 g/l | 1–5.0 g/l |
| Monoethanolamine | 17 g/l | 4–43.0 g/l |
| Sodium m-Nitrobenzene sulfonate | 1 g/l | 0.25–2.5 g/l |
| Molybdenum trioxide | 0.2 g/l | 0.05–0.5 g/l |

Contact time in this solution is usually about 1–3 minutes at about 80–150° F., resulting in the deposition of an opaque, gray iron phosphate intermediate coating.

Step 4: The article is rinsed in clean water to remove any acid solution residues from the surface.

Step 5 (Second Oxidation): The article is then oxidized to a colored surface by a second oxidation with an aqueous solution of oxidizing agents for a time sufficient to achieve the desired surface color. The composition of this second oxidation solution may include primary oxidizers along with such additional components as accelerators, metal chelators and surface tension reducers. Appropriate oxidizers include alkali metal compounds of hydroxide, nitrate, and nitrite. The oxidizing solution for the blackening reaction (the second oxidation) preferably contains three oxidizers, sodium hydroxide, sodium nitrate and sodium nitrite. If one of these oxidizers is omitted, the blackening reaction has been found to proceed less efficiently.

Appropriate accelerators for the second oxidation include organic and inorganic nitro compounds, alkali metal compounds of citrate, molybdate, polyphosphate, vanadate, chlorate, tungstate, thiocyanate, dichromate, stannate, sulfide and thiosulfate, and stannous chloride and stannic chloride. Suitable accelerators are chosen according to such considerations as cost and solubility. Appropriate metal chelators include alkali metal compounds of thiosulfate, sulfide, ethylene diamine tetraacetate, thiocyanate, gluconate, citrate, and tartrate. Suitable chelators are chosen according to such considerations as cost, solubility and reactivity. Appropriate surface tension reducers include alkylnaphthalene sulfonate and related compounds which are stable in high pH environments.

Suitable reaction parameters for the second oxidation are as follows: pH range: about 12.0–14.0, typically about 13.0–14.0; operating temperature range: about 120–220° F., typically about 160–200° F.; contact time range: about 0.5–10 min., typically about 2–5 min.

A typical composition and range of concentrations for the process solution for Step 5 are shown below:

| Component | Concentration | Acceptable Range |
|---|---|---|
| Sodium hydroxide | 100 g/l | 25–200 g/l |
| Sodium nitrate | 35 g/l | 8.75–70 g/l |
| Sodium nitrite | 5 g/l | 1–10 g/l |
| Sodium thiosulfate | 5 g/l | 1–10 g/l |
| Sodium molybdate | 5 g/l | 1–10 g/l |
| Tin (IV) Chloride | 0.2 g/l | .05–0.4 g/l |
| Petro AA | 0.1 g/l | .025–0.2 g/l |

Normal contact time for the second oxidation is about 2–10 minutes at about 160–220° F. The resulting coating may be black or brown in color, depending on exposure time, temperature and composition of the oxidizing solution.

Step 6: The article is rinsed in clean water to remove any oxidizing solution residues from the surface.

Step 7: The article is then sealed with a topcoat appropriate to the end use of the product, such as a lubricant, a rust preventative compound or a polymer-based topcoat.

Cleaning and rinsing techniques, such as those described above for Steps 1, 2, 4 and 6, may vary widely and are well-known to the metal finishing industry. Many different such techniques can be used, depending on the condition of the metal surface prior to blackening, the volume of work to be done, the finish requirements for the final finish, etc. Consequently, alternate cleaning and rinsing techniques, as recognized within the metal finishing industry may be used and can be determined by the operator of the process. The specific cleaning and rinsing techniques described above should be considered merely illustrative.

Following is a description of parameters of a seven-step sequence as described above used to produce a black finish on a substrate of 1018 low carbon steel panel, which exemplifies operation of the process of this invention at the extraordinarily low temperature of 80° F.:

Step 1: The panel is cleaned as above described.

Step 2: The panel is rinsed as above described.

Step 3 (First Oxidation): A dicarboxylate coating is provided.

Step 4: The panel is rinsed as above described.

Step 5 (Second Oxidation): The panel is oxidized to a produce a black finish.

Suitable reaction parameters for the second oxidation are as follows: pH range: about 12.0–14.0, typically about 13.0–14.0; operating temperature range: about 80° F.; contact time range: about 30 min.

The composition and concentrations for this process solution are shown below:

| Component | Concentration |
|---|---|
| Sodium hydroxide | 175 g/l |
| Sodium nitrate | 60 g/l |
| Sodium nitrite | 10 g/l |
| Sodium thiosulfate | 10 g/l |
| Sodium molybdate | 8 g/l |
| Tin (IV) Chloride | 0.5 g/l |
| Petro AA | 0.2 g/l |

Step 6: The panel is rinsed as above described.

Step 7: The panel is then sealed with a topcoat appropriate to its end use as above described, such as with a lubricant, a rust preventative compound or a polyrner-based topcoat.

That which is claimed is:

1. A ferrous metal coating composition comprising magnetite embedded within a crystalline coating on a ferrous metal surface.

2. The ferrous metal coating composition of claim 1, wherein the crystalline coating is iron dicarboxylate or iron phosphate.

3. A composition for coating a ferrous metal comprising a crystalline iron dicarboxylate or iron phosphate coated ferrous metal surface with magnetite embedded within the crystal structure of the dicarboxylate or iron phosphate.

4. A composition for coating a ferrous metal comprising a crystalline iron dicarboxylate or iron phosphate coated ferrous metal surface with magnetite embedded substantially within the top surface of the crystal structure of the dicarboxylate or iron phosphate.

5. A composition for coating a ferrous metal comprising a crystalline iron/oxygen-enriched oxidized coating on a ferrous metal surface with magnetite embedded within the crystal structure of the iron/oxygen-enriched oxidized coating.

6. The composition of claim 5, wherein the magnetite is embedded within the the top surface of the crystal structure of the iron/oxygen-enriched oxidized coating.

7. The composition of claim 5, wherein the coating rich in molecular iron and oxygen is iron dicarboxylate or iron phosphate.

8. The composition of claim 5, also comprising a topcoat on the coating.

9. The composition of claim 8, wherein the topcoat is a lubricant, a rust preventative, or a polymer-based compound.

10. A coated colored ferrous metal article having a surface formed by two treatments, wherein the first treatment comprises an iron/oxygen-enriched intermediate oxidized coating formed on the ferrous metal article, and the second treatment comprises a further oxidation of the first coating to convert the first coating to a magnetite coating on the ferrous metal article.

11. A ferrous metal article prepared according to a process for forming a hybrid conversion coating on a ferrous metal substrate, comprising the steps of:

(a) applying to the substrate an intermediate coating rich in molecular iron and oxygen;

(b) contacting the coated substrate of step (a) with an aqueous solution of oxidizing agents to form a surface that is predominantly magnetite, $Fe_3O_4$.

12. A ferrous metal article prepared according to the process of claim 11, wherein in step (a) the substrate is coated with a water insoluble dicarboxylate coating by contacting the substrate with an aqueous solution of a dicarboxylic acid at a concentration, pH, temperature and time to achieve a desired dicarboxylate coating.

13. A ferrous metal article prepared according to the process of claim 11, wherein in step (a) the substrate is coated with a water insoluble iron phosphate coating by contacting the substrate with an aqueous solution of a reagent selected from the group consisting of phosphoric acid, pyrophosphoric acid and salts and mixtures thereof, at a concentration, pH, temperature and time to achieve a desired phosphate coating.

14. A ferrous metal article prepared according to the process of claim 11, wherein in step (b) the coated substrate from step (a) is contacted with an aqueous solution of an oxidizing agent at a concentration, pH, temperature and time to form a coating of the desired amount of magnetite.

15. A ferrous metal article prepared according to the process of claim 12, wherein in step (a), the dicarboxylic acid is selected from the group consisting of oxalic acid, malonic acid, succinic acid, glutaric acid, adipic acid, pimelic acid, maleic acid, malic acid, tartaric acid, citric acid and mixtures thereof.

16. A ferrous metal article prepared according to the process of claim 14, wherein the dicarboxylic acid is oxalic acid at a concentration of about 3–35 grams per liter, a pH of about 0.5–2.5, a temperature of about 50–150 F, and a contact time of about 0.5–5.0 minutes.

17. A ferrous metal article prepared according to the process of claim 14, wherein in step (b) the aqueous oxidizing solution contains oxidizing agents selected from the group consisting of alkali metal hydroxide at concentrations of about 25–200 grams per liter, alkali metal nitrate at concentrations of about 9–70 grams per liter, and alkali metal nitrite at concentrations of about 1–10 grams per liter, a pH of about 13–14, a temperature of about 120–220 F, and a contact time of about 2–10 minutes.

18. A ferrous metal article prepared according to the process of claim 11, further comprising the step of sealing the substrate with a topcoat after step (b).

19. A ferrous metal article prepared according to the process of step claim 11, wherein in step (a) the substrate is coated in the presence of an additive selected from the group consisting of a grain refiner and an accelerator.

20. A ferrous metal article prepared according to the process of claim 19, wherein the grain refiner is alkali metal tartrate at a concentration of about 0.1–1.0 gram per liter.

21. A ferrous metal article prepared according to the process of claim 19, wherein the accelerator is selected from the group consisting of organic and inorganic nitro compounds, alkali metal salts of citrate, molybdate, polyphosphate, thiocyanate, chlorate and sulfide at concentrations of about 0.5–5.0 grams per liter.

22. A ferrous metal article prepared according to the process of claim 13, wherein in step (a) the substrate is coated in the presence of an accelerator.

23. A ferrous metal article prepared according to the process of claim 22, wherein the accelerator is selected from the group consisting of organic and inorganic nitro compounds at concentrations of about 0.1–5.0 grams per liter.

24. A ferrous metal article prepared according to the process of claim 11, wherein the coated substrate from step (a) is contacted in step (b) with an aqueous solution of oxidizing agents in the presence of an additive selected from the group consisting of an accelerator, a metal chelator and a surface tension reducer.

25. A ferrous metal article prepared according to the process of claim 24, wherein the accelerator is selected from the group consisting of alkali metal salts of molybdate, vanadate, tungstate, thiocyanate, dichromate, stannate, thiosulfate, stannous chloride, and stannic chloride at concentrations of about 0.05–0.5 grams per liter.

26. A ferrous metal article prepared according to the process of claim 24, wherein the metal chelator is selected from the group consisting of alkali metal salts of thiosulfate, sulfide, ethylene diamine tetraacetate, thiocyanate, gluconate, citrate or tartrate at concentrations of about 1.0–10.0 grams per liter.

27. A ferrous metal article prepared according to the process of claim 24, wherein the surface tension reducer is selected from the group consisting of alkylnaphthalene sulfonate at concentrations of about 0.025–0.2 grains per liter.

* * * * *